US005681043A

United States Patent [19]

Winblad et al.

[11] Patent Number: 5,681,043

[45] Date of Patent: Oct. 28, 1997

[54] COMPRESSION ACTUATED GAME OR SIMULATION APPARATUS

[75] Inventors: Wade Winblad, Hayward; Fred Miller, Sunnyvale, both of Calif.

[73] Assignee: Atari Games Corporation, Milpitas, Calif.

[21] Appl. No.: 357,432

[22] Filed: Dec. 15, 1994

[51] Int. Cl.[6] ..... A63F 7/20

[52] U.S. Cl. ..... 273/317.3; 273/399; 124/64

[58] Field of Search ..... 273/399–402, 273/85 H, 85 F, 85 E, 1.5 R, 317.3, 397; 124/64, 61, 63, 65–68; 446/197; 473/478, 479, 485–489

[56] References Cited

U.S. PATENT DOCUMENTS

| | | | |
|---|---|---|---|
| 943,472 | 12/1909 | Schreiber et al. | 273/85 H |
| 2,085,206 | 6/1937 | Holmdahl | 273/1.5 R |
| 2,433,224 | 12/1947 | Koci et al. | 273/317.3 |
| 2,720,397 | 10/1955 | Blanton | 273/317.3 |
| 4,013,292 | 3/1977 | Cohen et al. | 273/317.3 X |
| 4,699,386 | 10/1987 | Carzino | 273/397 X |
| 4,995,844 | 2/1991 | McNett et al. | 446/197 X |
| 5,343,850 | 9/1994 | Steer | 124/64 |
| 5,421,764 | 6/1995 | Namiki | 446/197 |

FOREIGN PATENT DOCUMENTS

| | | | |
|---|---|---|---|
| 1033929 | 4/1953 | France | 124/64 |
| 2358908 | 2/1978 | France | 273/85 H |
| 646646 | 10/1962 | Italy | 273/399 |

OTHER PUBLICATIONS

Hindman, Kick the Can and Over 800 Other Active Games and Sports For All Ages, p. 362, Multiple–Goal Basketball, Jun. 1984.

*Primary Examiner*—Paul E. Shapiro

*Attorney, Agent, or Firm*—Knobbe, Martens Olsen & Bear, LLP

[57] ABSTRACT

An apparatus providing a novel challenge to skill and dexterity includes a projectile and a deformable container having a drive medium contained therein. The deformable container is in fluid communication with a launch member, such that deformation of the container is communicated to the launch member, thereby causing the launch member to impact the projectile. Deformation may be caused by physical pressure applied by an operator. In this case, when an operator strikes the deformable container, it is compressed, forcing the drive medium, which may be air, to the launch member, which may be a piston, causing the launch member to strike a game ball, sending it toward the target. The deformable container may comprise resilient and rigid foam. Alternatively, a plurality of independently compressible containers, each actuating a separate piston or other launch member may be provided. The separate launch members are positioned adjacent to one another, and direct the projectile in different directions, the resulting projectile trajectory determined by the vector sum of the individual impacts. A plurality of targets in vertical arrangement may also be provided, as well as a mechanism for loading game projectiles onto a resting location from which they are propelled toward the target.

55 Claims, 5 Drawing Sheets

COMPRESSION ACTUATED GAME OR SIMULATION APPARATUS

BACKGROUND OF THE INVENTION

Many different forms of game and simulation apparatus are known where a player or players direct a game projectile, usually a ball, toward a goal or other target to simulate various sports such as basketball or soccer. In order to simulate these sports and to challenge various aspects of skill and dexterity many different means have been employed to provide operator control of the ball toward or away from a particular goal. Several U.S. patents are illustrative examples of such games.

In one type of well known game system, applicable to simulation of hockey, soccer, or similar games, operator actuated paddles are fixed in various locations on the game surface. By actuating the correct paddle when the game ball is near, the ball can be propelled in a particular direction. U.S. Pat. No. 4,973,056 to Nutting is an example of such a system. A different form of ball control is described in U.S. Pat. No. 3,960,378 to Bahr. This patent discloses a game apparatus which contains several operator adjustable tubes provided with angled nozzles. By adjusting the position of the nozzle and squeezing an associated air bulb at the appropriate moment, the player can control the game ball with a directed jet of air.

In some games, the operator can control the speed at which the projectile is fired by varying the force of impact with a paddle or other ball propulsion mechanism. For instance, U.S. Pat. No. 1,827,885 to Emenhiser discloses a game wherein the operator controls the force of impact of an air driven piston on a game ball by controlling the speed at which the operator rotates a crank. Such operator control is important because it requires the operator to exercise skill and judgement when playing the game. Different methods of ball control allow different tests of dexterity, and new variations in ball control means provide these games with continuing operator interest.

Prior to the present invention, apparatus of this kind could vary ball speed based on the force with which an operator struck a propulsion mechanism, but provided for no variation in direction or location of operator impact with the propulsion mechanism. It would provide a new test of operator skill and an opportunity for improved control if changes in speed and trajectory of the ball were created by variations in the direction or location of operator impact with a propulsion mechanism. Furthermore, currently known games only allow a single propulsion mechanism to direct the ball at any one time. In essence, a series of intermittent impacts with a paddle or an air stream produces ball motion when playing the game. No games challenge the skill of an operator at directing ball motion by creating several impacts on the ball following a single operator input, each impact of different magnitude and direction. This type of ball control can provide more interesting play because predicting the speed and direction of ball propulsion becomes more difficult.

In addition, some apparatus found in the prior art provide a single target that a player will shoot towards with each given impact. A new challenge would be provided if there were two or more targets, situated so that the operator could attempt to hit more than one such target with a single impact of the ball.

SUMMARY OF THE INVENTION

Generally, the present invention comprises a system for launching a projectile toward a target, the system comprising a projectile, a deformable container having a drive medium contained therein, a launch member in fluid communication with the deformable container and responsive to the drive medium such that deformation of the container is communicated to the launch member via drive medium flow to cause the launch member to impact the projectile, and a target positioned with respect to the launch member such that launch member impact with the projectile may cause the projectile to travel toward the target. The drive medium may be a liquid or a gas, and the deformable container may be deformed in response to physical pressure applied by an operator.

The launch member may be a piston, and the piston may be in fluid communication with the deformable container via a conduit extending between the container and the piston so as to communicate the drive medium to the piston.

In addition, a plurality of targets, may be provided, at least one of which is mounted above another, such that a single launch member impact with the projectile may cause the projectile to travel through more than one of the targets.

Also, a plurality of deformable containers may be independently in fluid communication with a plurality of launch members. Two or more of the plurality of launch members may be positioned adjacent to each other, such that each launch member will impact the projectile if actuated when the projectile is near the launch members. Challenging play is provided if the longitudinal axes of the two or more adjacent pistons diverge.

In one preferred embodiment, the deformable container may comprise resilient material within the interior thereof for returning the deformable container to its initial configuration following deformation. The deformable container may comprise a resilient foam portion and a rigid foam portion such that the resilient foam portion returns the deformable container to its initial configuration following deformation and the rigid foam portion restricts the container's capacity for deformation. The resilient foam portion may be open cell polyurethane foam and the rigid foam portion may be closed cell polyethylene foam.

In another preferred embodiment, the invention comprises a game or simulation apparatus which includes a projectile, a projectile impact location, and a plurality of pistons, the plurality of pistons being situated proximate to a projectile impact location such that each piston will impact the projectile if actuated when the projectile is at the projectile impact location. The longitudinal axes of the cylinders may or may not be parallel.

Actuation of the pistons in the cylinders may be accomplished by use of a plurality of air pockets with a plurality of conduits for separate pressure communication between each air pocket and each cylinder such that an air pocket compression actuates a corresponding piston, thereby causing piston impact with the projectile. The air pockets may be flexible cylindrical bellows with one end fixed with respect to the remainder of the apparatus, and the other end movable with respect to the remainder of the apparatus.

Furthermore, multiple targets, which in one preferred embodiment may be simulated basketball nets, can be provided. These targets can be provided in a vertical arrangement, such that a single impact on a projectile may cause the projectile to pass through more than one target. Also, multiple projectiles and projectile loading onto a projectile impact location proximate the launch member may be provided.

DETAILED DESCRIPTION OF THE PREFERRED EMBODIMENT

Figure 1:
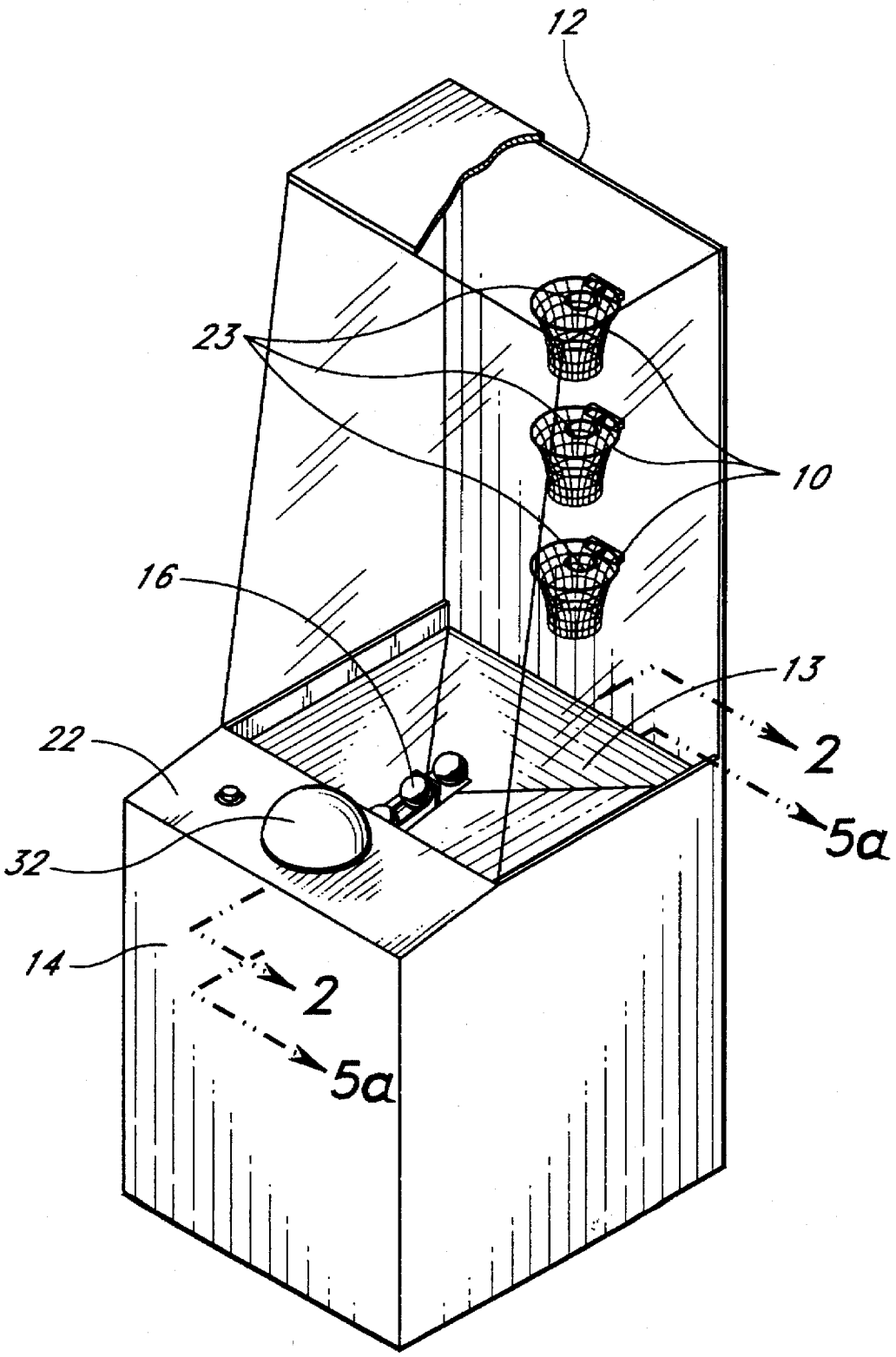
FIG. 1 is a perspective view of one preferred embodiment of a game apparatus embodying the present invention, showing targets which simulate basketball nets, and operator controllable means to control the impact of a piston with the game ball.

An overall perspective view of an exemplary game apparatus embodying the present invention is shown in FIG. 1. The game is comprised of three targets 10, made to simulate basketball nets. The targets 10 are secured to a rear wall 12, which provides the rear boundary of the game area. Also provided are three balls 16, to be projected at the targets 10, by the operator. The balls are preferably standard table tennis balls, which may be colored to more closely resemble basketballs. This type of ball provides a good weight and bouncing action to create interesting play. Of course, any of numerous types of ball embodiments can be used in this apparatus. Although any number of balls may be provided, it has been found that with four balls in play at once, play can be nearly continuous, since two balls will be bouncing near the targets, one ball will be rolling toward the front of the play area, and one ball will be near the propulsion mechanism.

The bottom 13 of the play area is contiguously sloped from the rear and sides toward the front and center of the play area, so that after landing on the bottom 13, the balls 16 are continually fed toward the propulsion mechanism. The bottom 13 of the play area further defines the top of a base housing 14 of the game. The base housing may be made from many materials, including wood, plastic, or metal. The base housing 14 is preferably opaque, and houses the apparatus for projecting the balls. The height of the base is sufficient to support a game area at a height comfortable for a player to stand and operate the game. The balls are confined inside a region making up the game area, which is defined by the wall 12 in the rear, another opaque panel defining the top, and by transparent plastic front and side panels.

At a height which is comfortable for operator play, the vertical extension of the front surface of the base housing 14 terminates, and the base housing 14 then extends rearwardly at a shallow angle, creating a game play face 22. The game face is provided with an operator actuation surface 32, which controls the ball propulsion mechanism. The surface 32 is approximately hemispherical in shape, and protrudes outward from the game face 22. As will be described in detail below, when an operator strikes the actuation surface 32, the ball 16 will be projected towards the targets 10.

In one embodiment, a player scores points by successfully making a ball pass through one or more baskets. To detect a successful shot, each basket is provided with a rigid piano wire actuator 23 which is pushed down by the ball 16 as the ball passes through. It is preferable for the actuator 23 to terminate in a small loop within the simulated basketball net. This actuator is secured to an actuator of a normally open microswitch (not shown) mounted to the rear panel 12. This momentarily closes the contacts of the microswitch, causing the addition of the appropriate amount of points to a player's running total score. It can be appreciated that more points can be awarded for making the ball pass through higher, more difficult baskets, with the awarded points decreasing with each lower basket. It can also be appreciated that a player will score the most points by having a ball pass through all three baskets after a single impact.

Figure 2:
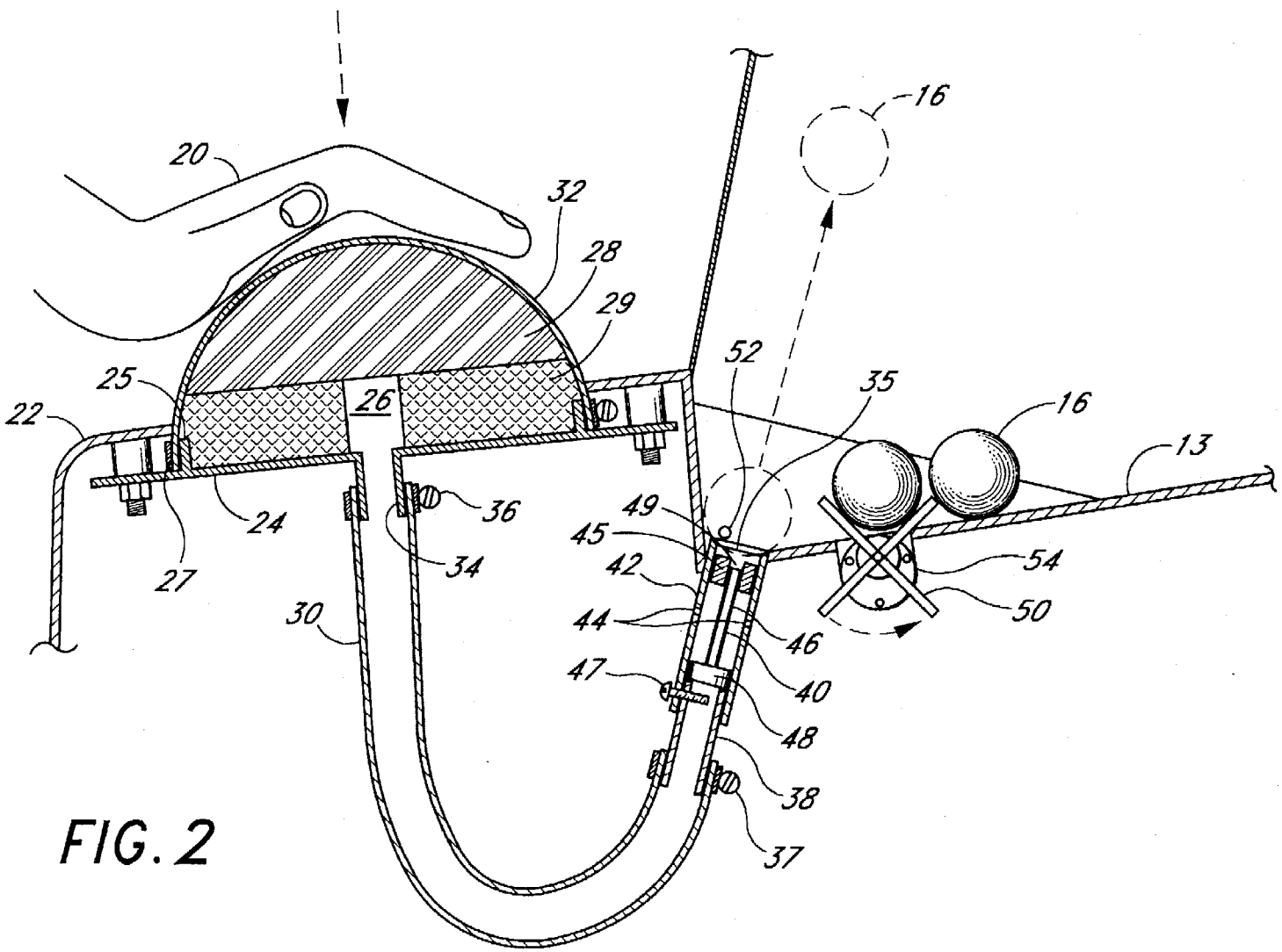
FIG. 2 is a cutaway, internal view of a portion of the game in FIG. 1, taken along lines 2—2 of FIG. 1, showing an air pocket which is manually compressible by an operator and the means by which the compressed air actuates the piston which impacts the game ball.

FIG. 2 illustrates the details of one preferred embodiment of an operator controlled propulsion mechanism. The operator actuation surface 32 is comprised of approximately one half of a reduced size plastic, rubber, or leather ball, such as a basketball, which has been cut approximately along its equator. This produces a partial sphere, which is used as the operator actuation surface for the game apparatus described. The basketball surface 32 is secured to a manifold plate 24. To hold the basketball surface 32 to the manifold plate 24, the manifold plate 24 is provided with a circular ridge 25 having a radius approximately equal to but less than that of the basketball surface 32. The basketball surface 32 is placed around the ridge 25, and is secured there with a suitable hose clamp 27, which is tightened around the outer bottom edge of the basketball surface 32. The manifold plate 24 is secured to the game face 22 with screws and spacers such that it hangs beneath the game face 22. The manifold plate 24 hangs below a hole in the game face 22, so that the basketball surface 32 protrudes above the game face 22, allowing operator contact with the basketball surface 32.

The upper half of the hemispherical region bounded by the basketball surface 32 and manifold plate 24 is filled with a piece of resilient open cell polyurethane foam 28. This resilient foam piece 28 rests on a base of rigid closed cell polyethylene foam 29 which fills most of the remaining hemispherical region beneath the basketball surface 32. The rigid foam piece 29 is further provided with an axially located hole 26, such that it is shaped like a thick washer or donut. The rigid foam piece may or may not be provided with additional holes which vent the top surface of the rigid foam piece 29 into the central opening 26. It is not necessary to provide any adhesive or sealant at the interface surface of the two foam pieces or at the interface between the rigid foam 29 and the manifold plate 24. It can be appreciated that the region bounded by the basketball surface 32 and the manifold plate 24 forms a deformable and compressible container which contains both foam and air. If the resilient foam 28 is compressed, trapped air in the resilient foam 28 will be pushed into the hole 26 in the rigid foam 29.

It is possible to create a suitable apparatus wherein the deformable container contains only air and resilient open cell foam. In an embodiment of this type, the resilient foam is shaped as a hemispherical shell with outer radius approximately equal to the basketball surface 32, and inner radius approximately ½ the radius of the basketball surface 32. This construction creates an air pocket between the inner surface of the resilient foam shell and the manifold plate. When the resilient foam is compressed, the air pocket is compressed, forcing air down toward the manifold plate 24. Although this construction allows suitable game play, it has been found that the foam filled container construction illustrated in FIG. 2 allows the basketball surface 32 to better retain the appropriate hemispherical shape.

As is shown in FIG. 2, an opening is provided in the manifold plate 24 at the base of the hole 26 in the rigid foam piece 29. This opening is provided with a nipple 34, allowing air to pass through the opening of the manifold plate 24. The nipple provides a fitting for a hose 30, suitably sized to fit snugly over the nipple 34. The other end of the hose 30 fits snugly over a stop tube 38 which is attached to the base of a cylinder 42, described in more detail below. Each end of the hose 30 is secured with hose clamps 36, 37 to its associated cylinder 42 or nipple 34.

The cylinder 42 has outside diameter which is less than that of a game ball 16, and mounts in the center front of the bottom panel 13 of the play area. The cylinder 42 is mounted such that its longitudinal axis is angled slightly away from vertical, and toward the baskets 10. The top of the cylinder 42 is open, and provides a resting position for a game ball 16. Preferably, the top edge 35 of the cylinder is beveled to facilitate accommodation of a ball 16. The front edge of the cylinder 42 top is positioned to be flush with the sloping bottom panel 13, so that a game ball will naturally roll to rest onto the top of the cylinder 42.

Inside the cylinder 42 is a launch member, in this embodiment a piston 40, which is comprised of a thin (relative to the inner diameter of the cylinder 42), upwardly extending shaft section 46 which comprises the majority of the piston's overall length, and a base section 48, comprising the rest of the piston length. The base section 48 has a radial extension nearly to the inner cylinder 42 wall. Preferably, the diameter of the piston base 48 is approximately 3 mil less than the inner diameter of cylinder 42.

Downward piston travel is limited by the stop tube 38. The stop tube 38 comprises a cylinder with outer diameter slightly less than the inner diameter of the cylinder 42. The stop tube 38 is inserted a short distance into the cylinder 42, and is secured there with a retaining screw or bolt 47 which is threaded through adjacent holes in both the lower portion of the cylinder 42 and the stop tube 38. Since the cylinder 42 is mounted nearly vertically, the piston base rests on the top edge of the stop tube 38 when at rest. In this position, the piston shaft 46 extends axially upward through an annular ring 45, and terminates near the top of the cylinder 42. The ring 45 can be either threaded or pressed into the upper portion of cylinder 42. When a game ball 16 is at rest on the top of the open cylinder 42, the top of the piston shaft 46 is just below the bottom of the ball 16. Performance is improved if a hole 49 is drilled into the center top of the piston shaft 46, so that the piston shaft 46 makes contact with the ball along a ring, rather than at a point of contact between the round surface of the ball 16 and the flat surface of the top of the piston shaft 46.

Given the position of the cylinder 42 in the bottom panel 13, upward piston travel will begin to make the piston shaft 46 extend through the bottom panel 13 and up into the game area. This upward travel is limited by the bottom of the annular ring 45, because the piston base 48 is too wide to pass through the central opening of the ring 45. The ring 45 provides the additional function of keeping the piston shaft 46 centered as the diameter of the central opening in the ring is only slightly larger than the diameter of the piston shaft 46.

Piston actuation is accomplished in the following manner. When a player strikes the basketball surface 32 with a hand or fist 20, the resilient foam pocket 28 is compressed, forcing air out the hole 26 in the rigid foam piece 29, through the tube 30 and into the cylinder 42. This air pushes up on the piston base 48, causing the piston shaft 46 to move up and strike a game ball 16 resting on the top of the open cylinder 42. In order to allow free piston travel, the portion of the cylinder above the piston base 48 is vented through one or more holes 44 provided in the cylinder walls or in the annular ring 45. The preferred embodiment uses air as the medium which drives the launch member. The same principles, however, would be applicable to alternative drive mediums such as liquids. It can be seen that the manner in which the operator strikes the surface 32 will change the compression of the air pocket 26, and consequently, the speed of piston travel and resulting ball speed. Not only will variations in impact force vary the deformation and compression of the container which contains the foam 28, and therefore ball speed, but variations in location or angle of impact will also affect ball speed.

During play, game balls 16 are continuously loaded to the top of cylinder 42 by a rotating paddle 50. The paddle 50 is attached to the drive shaft of a motor 54. The motor 54 is mounted to the underside of the bottom 13 of the game area such that the paddle 50 extends through a suitable cutout up into the game area a short distance rearward from the top of the cylinder 42. When the paddle 50 is rotating, any balls which roll down to the paddle 50 are pushed toward the resting location on the top of the cylinder 42. If the paddle 50 is not rotating, balls rolling down to the paddle 50 will be prevented from reaching the top of the cylinder 42 due to the presence of the stationary paddle 50 blades.

The motor can be of almost any type. A 19.5 Vdc servo motor with a free running speed of 1200 RPM geared down to produce a paddle rotation of 60 RPM has been found suitable. Rather than providing continuous paddle rotation, it is preferable to have the paddle stop rotating if a game ball is already positioned on the top of the cylinder 42. This feature is provided by a photosensor 52 adjacent to the top of the cylinder 42. When the light path between the photosensor 52 and a light source located across the top of the cylinder 42 is blocked by the presence of a game ball 16, the motor 54 is shut off until the ball is propelled away from the light path by the piston 46.

The apparatus described above can be modified to create more difficult and challenging play by providing additional launch members, each of which is coupled to a separate drive medium containing deformable container via a dedicated hose. Each launch member may direct the ball in a slightly different direction and with an independently controllable force. If all of the separate containers remain beneath one actuation surface as in the apparatus described above, a single operator impact may actuate the launch members separately. In such an apparatus, the trajectory of the game ball would be determined by the net force applied to it from the separate launch members. An embodiment of this type wherein the launch members are pistons, and the drive medium is air is shown in FIGS. 3*a*, 3*b*, 4, 5*a*, and 5*b*.

Figure 3A:
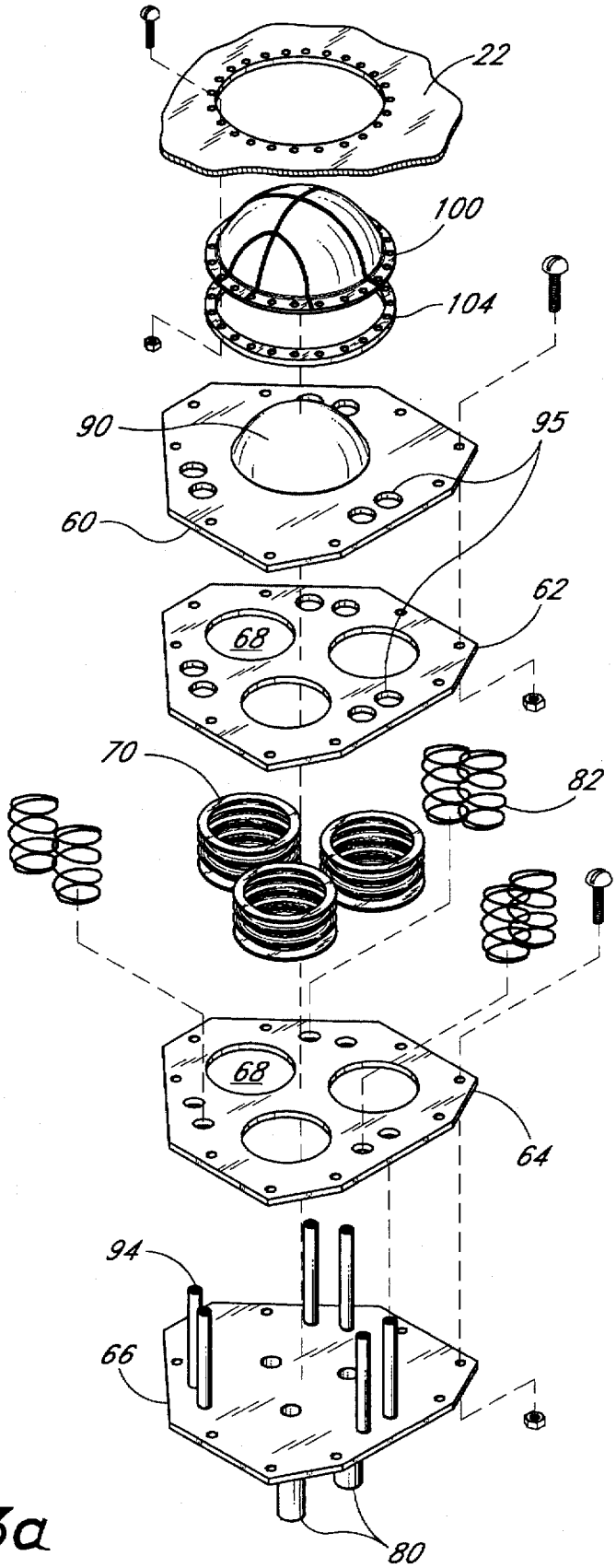
FIG. 3*a* is an exploded perspective view of a portion of an apparatus comprising multiple air pockets and pistons, showing bellows which enclose air pockets, plates to which the bellows are attached, and an operator impact surface for operator compression of the bellows.
Figure 3B:
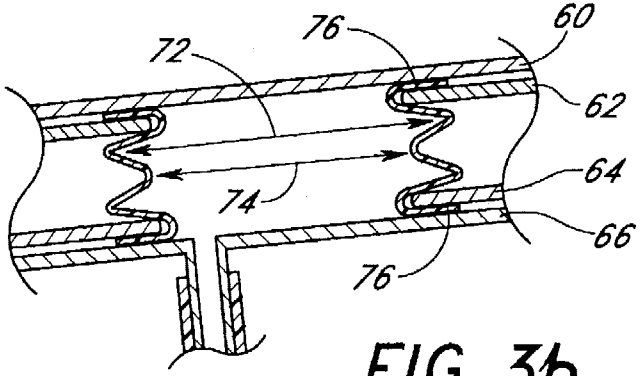
FIG. 3*b* is a cutaway detail view of the securement of the bellows of FIG. 3*a*, taken along lines 3*b*—3*b* of FIG. 5*a*, illustrating bellows attachment to the metal plates which allow operator controlled independent compression of the bellows.

In the system illustrated in FIGS. 3*a*, 3*b*, 4, 5*a*, and 5*b*, two plates 62, 64 are provided as illustrated in FIG. 3*a*, both of which have three circular openings 68 of equal size. Also provided are three cylindrical bellows 70, made of rubber or other flexible material. The preferred bellows comprise axially compressible tubes, the compressibility of which is provided by a series of axially spaced radial folds along their length. These folds produce circumferential ridges defining a characteristic smaller diameter 72 and larger diameter 74 at different points along the bellows length, as is shown in FIG. 3*b*. This allows "accordion" like axial compression and expansion. The bellows provided have a smaller diameter 72 approximately equal to the diameter of the holes 68 in each of the two above described plates 62, 64.

The two plates 62, 64 are joined together by the three bellows 70, as is shown in detail in FIG. 3*b*. One end of each flexible bellow is threaded through a different one of the three holes 68 in one of the plates 62, 64, leaving a bellow lip region 76 on one side of the plate, and the main portion of the bellows 70 on the other. The lip region extends out a distance which is approximately equal to the difference between the bellows' smaller diameter 72 and its larger diameter 74. The other end of each bellows 70 is similarly threaded through the corresponding hole 68 in the other plate 64, 62, also leaving a lip region 76 on the opposite side of the plate 64, 62 as the body of the bellows 70.

To seal the bellows 70 to the plates 62, 64, two additional plates 60, 66, are provided. These two plates are of the same size and shape as the plates 62, 64. One of these plates 60 comprises solid metal in the regions near where the plates 62, 64 contain bellows openings. This plate 60 is secured to one of the bellows connected plates 62 with screws and nuts, pinching the lip regions 76 of the bellows in between. This effectively seals one end of each of the three bellows.

Another plate 66 is also provided, which is secured in a similar fashion to the other bellows connected plate 64, again pinching the bellows lip regions 76 between the two. This plate 66, however, is further provided with three nipples 80 connected to three openings in the plate 66. These three nipple openings are situated such that after the plate 66 is secured to the plate 64, each of the bellows is vented by a different nipple 80.

Thus, three separately vented compressible air pockets are created by the assembly of bellows and plates. Because the plates are relatively heavy, and the bellows are easily compressible, it is preferable to additionally provide several springs 82 compressed between the two sets of plates, so that the bellows are extended when the assembly is in its stable resting configuration. It can be seen that the two plate pairs naturally rest in parallel planes which are separated by the length of the springs and bellows. However, the springs and bellows can be manually compressed unequally to make this no longer true. In other words, by varying the location of a compressing force applied to the plates, each bellows can to a large extent be compressed and vented either independently of the other two, or in conjunction with another one or both of the other bellows 70.

Figure 4:
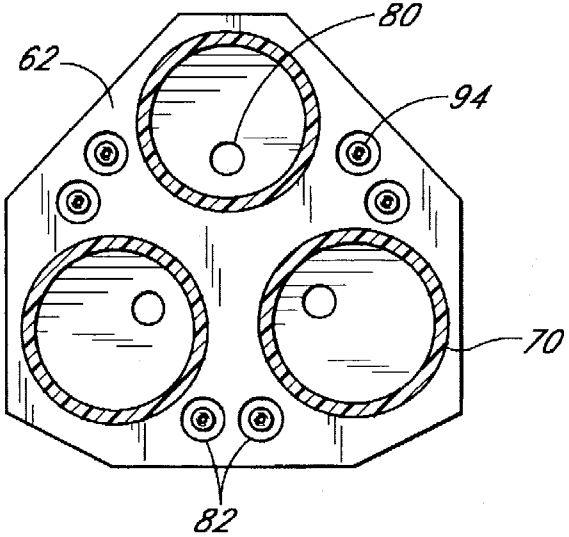
FIG. 4 is a top plan view of the bellows and plates of FIGS. 3*a* and 3*b*, taken from perspective 4—4 of FIG. 5*a*, showing the geometrical arrangement of the associated bellows, vents, and springs.
Figure 5B:
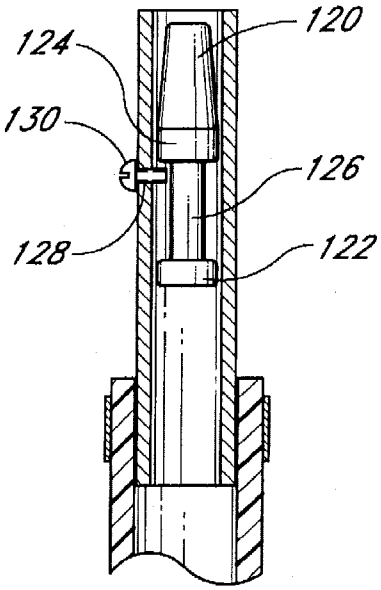
FIG. 5*b* is a cutaway view of the piston and cylinder combination of the apparatus of FIG. 3, taken along lines 5*b*—5*b* of FIG. 5*a*.

FIG. 4 illustrates one preferred arrangement of bellows 70, springs 82, and vents 80 in a plate and bellows assembly. If the "central axis" of the plate and bellows assembly is defined as the axis perpendicular to the planes of the plates and running through their center, it has been found preferable to place the axis of each bellows radially away from the central axis of the assembly, and spaced evenly angularly around the central axis. When three bellows are provided, their axes are 120 degrees apart. Six springs 82 may be provided in three pairs, each pair of springs placed radially outward of the three bellows axes, and angularly between the bellows 70. It has been found preferable to place each vent nipple 80 at the same angular location as its corresponding bellows axis, but radially inward toward the center of the plate 66 from the bellows axis.

Hereafter, the term "top plate pair" will refer to the plate pair 60, 62 described above which does not contain vents, and the term "bottom plate pair" will refer to the plate pair 64, 66 described above which does contain vents.

Secured to the top plate pair 60, 62 by screws is a solid sphere portion 90 which can be made of either wood or another rigid material such as plastic or metal. A thin layer (relative to the thickness of the sphere portion 90) of open cell polyurethane foam 92 is secured to the top of the sphere portion 90 with adhesive.

As is shown in FIG. 3*a*, secured around the edge of the bottom plate pair with screws are six metal spacers 94 which extend through the top plate pair 60, 62 through holes 95 in the top plate pair 60, 62. These holes in the top plate pair are of larger diameter than the spacers, so that the spacers do not touch the top plate pair 60, 62. Preferably, the diameter of the holes 95 is less than the diameter of the springs 82, and each spring 82 surrounds each spacer 94. This conveniently retains the springs 82 in place. The spacers 94 are longer than the springs, so that when the springs 94 and bellows 70 are extended, the spacers 94 remain extended up through the holes in the top plate pair 60, 62.

Figure 5A:
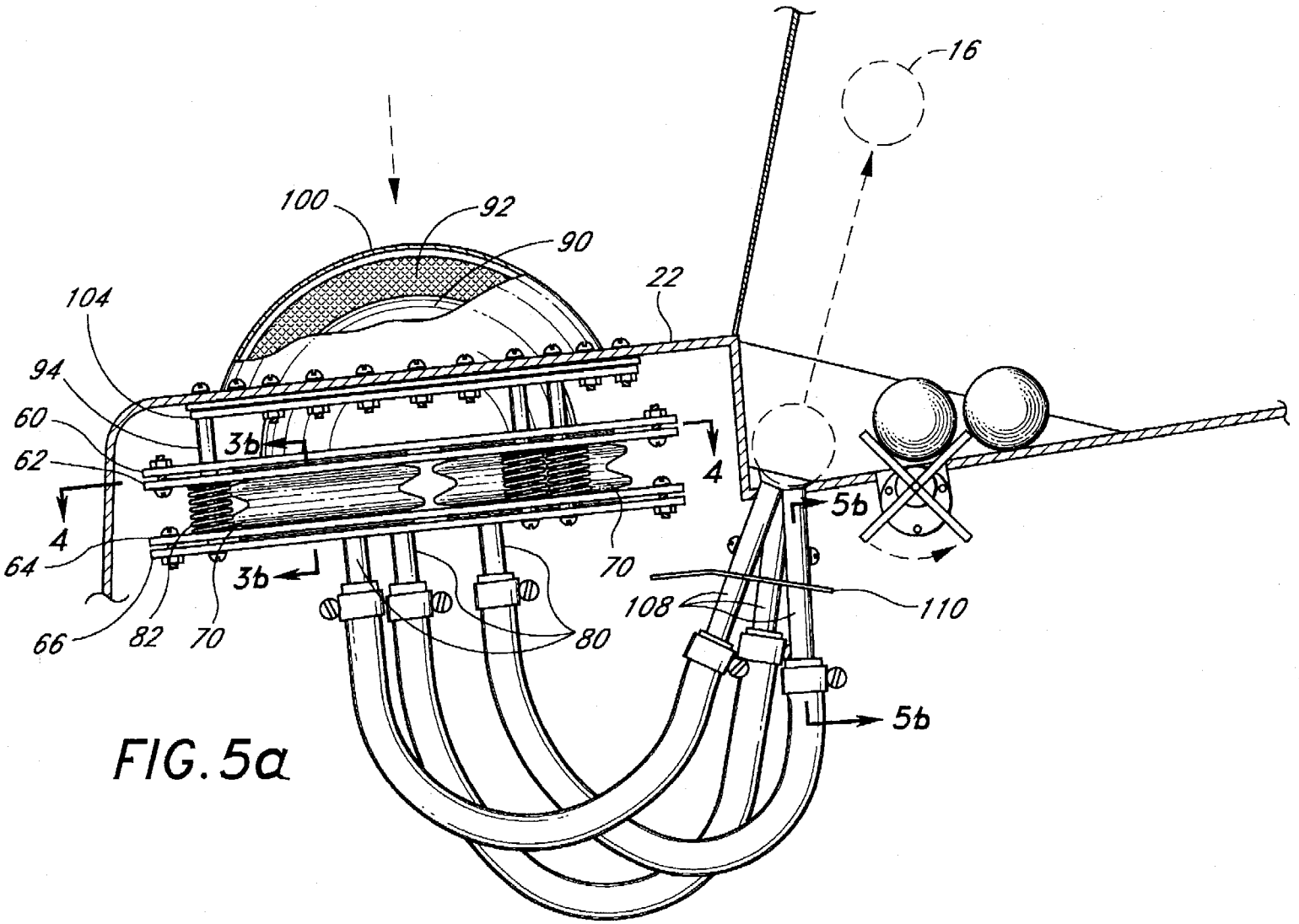
FIG. 5*a* is a cutaway internal view of the apparatus of FIGS. 3*a*, 3*b*, and 4 installed in a game apparatus with perspective appearance identical to that shown in FIG. 1, the cutaway view being along lines 5*a*—5*a* of FIG. 1, showing the compressible bellows and corresponding pistons and cylinders, and additionally showing the construction of the operator impact surface.

When this apparatus is installed in a game or simulation apparatus, as is illustrated in FIG. 5*a*, the spacers 94 are secured with screws or nuts to the underside of the game play face 22, such that the two plate pairs 60, 62, 64, 66 hang below the game face 22, with the top plate pair 60, 62 above the bottom plate pair 64, 66. Although the spacers 94 extend up through the top surface of the top plate pair 60, 62, they do not extend past the top of the attached sphere portion 90. Therefore, after attachment of the spacers 94 to the underside of the game face 22, the sphere portion 90 protrudes above the game face 22, through a suitably sized opening in the game face 22.

Because the spacers 94 do not make contact with the top plate pair 60, 62, only the bottom plate pair 64, 66 is fixed to the game face 22 via the spacers 94. The top plate pair 60, 62 with its attached sphere portion 90 is held in place relative to the rest of the game apparatus only by the springs 82 and bellows 70. Downward pressure on the sphere portion 90 pushes the top plate pair 60, 62 down, while the bottom plate pair 64, 66 remains fixed, thereby forcing the bellows 70 to compress. It can be appreciated that an angled or off center downward force on the hemisphere 90 will compress the different bellows 70 by differing amounts.

The foam 92 covering the hemisphere 90 is further covered with a flexible operator actuation surface 100, which, in one preferred embodiment, is comprised of a portion of a reduced size plastic, rubber, or leather basketball which has been cut approximately along its equator. Portions smaller than a full half basketball may also be used. The operator actuation surface 100 is placed in contact with the foam 92, and is fixed to the underside of the game face 22 with a ring 102. The ring has diameter slightly larger than the hole in the game face 22 through which the foam pad 92 protrudes, and the actuation surface 100 is secured between the ring 102 and the underside of the game face 22 with screws and nuts.

Each of the three nipples 80 which vent the air pockets inside each bellows 70 is attached to a separate hose 106, the other end of each hose being attached to a separate cylinder 108. Each cylinder 108 is fixed adjacent to the other two in the bottom panel 13 of the game area.

In this embodiment, the longitudinal axes of the cylinders 108 are not parallel, but diverge as they descend from the bottom panel 13. Each piston, therefore, will propel a projectile in a different direction. The direction will depend on the orientation angle of the cylinder relative to the bottom panel 13. In the preferred embodiment, all three cylinders are pointed in the general direction of the targets, as is the case with the single piston embodiment. The divergence of the three cylinders may be varied depending on what degree of difficulty in projectile control is desired. The greater the divergence, the more difficult it is to propel the ball 16 straight toward the targets 10.

In an embodiment suitable for projectiles comprising table tennis balls, the cylinders may be approximately 5¼ in. long, and have approximately ½ in. outer diameter. The divergence of the cylinders 108 as they extend down from the ball impact location may be such that the length of each side of an equilateral triangle formed by the intersection of a transverse plane with the longitudinal axes of the cylinders changes from approximately ½ in. at the ball impact location (equal to the cylinder diameter because the outer surface of the cylinders touch at that end) to approximately 1 13/16 in. at the other end of the cylinders. Several means for fixing the cylinders 108 in this configuration will be apparent to those skilled in the art. In one preferred embodiment, the ends of the cylinders 108 at the ball resting location are spot welded at the three points where the cylinders 108 meet, and are also spot welded where they pass through three appropriately spaced openings in a sheet metal plate 110 provided at approximately the midpoint of the cylinders' length.

Piston and cylinder design may be the same as is described above in conjunction with the single piston embodiment, or variations may be provided. As is illustrated in FIG. *5b*, one possibility is to provide a solid metal or plastic piston 120, machined with a base region which extends radially outward proximate to the inner cylinder 108 wall. As above, approximately 3 mil difference between piston base 122 diameter and cylinder 108 inner diameter is suitable. The piston 120 is further provided with a head region 124, which also extends so as to be proximate the inner cylinder wall. The diameter of the head region can, however, be slightly less than that of the base region 122. The central portion of the piston 126 between the base 122 and head 124 is machined to have a significantly smaller diameter than either the piston base 122 or head region 124.

Each cylinder is provided with a threaded hole 128, near the top of the cylinder. A piston 120 is placed inside each cylinder 108, with its narrow central region 126 adjacent the above mentioned threaded hole 128 in the cylinder wall. A retaining device such as a screw 130 is threaded through the hole, with length sufficient to extend into the bore of the cylinder, but insufficient to reach the narrow portion of the piston. After screw insertion, the piston is captive, as neither the head region 124 nor the base region 122 can move past the screw.

The distance between the top of the cylinder 108 and the screw 130 is chosen such that the top of the piston 120 is just beneath the top of the cylinder 108 when the piston is at rest with the bottom of the head region 124 in contact with the screw 130. One inch is a suitable length for the ½ in. diameter cylinders described above. Furthermore, the length of the narrow central region 126 of the piston is chosen such that when the piston is actuated upward to impact a ball or other projectile, the base region contacts the screw when the piston has a desired extension above the top of the cylinder. In an embodiment provided with ½ in. diameter, 5¼ in. long cylinders, this distance may be approximately ⅝ in.

Similar to the single piston embodiment, piston actuation is accomplished by operator impact upon the actuation surface 100, which causes the top plate pair 60, 62 to move downward, compressing the bellows 70, and forcing air into one or more of the cylinders 108. The air forced into the cylinders pushes up on one or more pistons 120, which strike the ball 16, and send it toward the targets 10.

It can be appreciated that not only ball speed, but also ball direction will be affected by the location and angle of operator impact with the actuation surface 100. This is because the different bellows may be unequally compressed by the impact, causing the different pistons to actuate at different speeds, thereby hitting the ball with different impact forces. Because each cylinder points in a different direction, the ball speed and trajectory will be determined by the vector sum of the three separate impacts. A straight trajectory through the targets requires a very precisely placed impact to the actuation surface 100. This feature challenges operator skill and dexterity in a way previously unknown to the art.

The provision of automatic ball loading with a motor controlled paddle may be provided with this multiple piston apparatus exactly as is described above.

Many variations to the above described invention will be apparent to those skilled in the art. For instance, two game areas could be combined into a single apparatus to provide for two player competitive play. Therefore, the description above has been in relation to preferred embodiments which are intended to be illustrative but not limiting. Accordingly, the scope of the present invention is intended to be defined by the appended claims and their equivalents.

What is claimed is:

1. A system for launching a projectile toward a target comprising:

a projectile;

a deformable container having a drive medium contained therein, and comprising material within the interior thereof for returning the deformable container to its initial configuration following deformation, said material forming a pocket enclosing a portion of said drive medium;

a launch member in fluid communication with the deformable container and responsive to the drive medium such that deformation of the container is communicated to the launch member via the drive medium to cause the launch member to impact the projectile; and, a target positioned with respect to the launch member such that launch member impact with the projectile may cause the projectile to travel toward the target.

2. The system of claim 1 wherein the drive medium is a liquid.

3. The system of claim i wherein the drive medium is a gas.

4. The system of claim 1 wherein the container is deformed in response to physical pressure applied by an operator.

5. The system of claim 1 wherein the launch member is a piston.

6. The system of claim 1 wherein fluid communication between the deformable container and the launch member is accomplished via a conduit extending between the container and the launch member so as to communicate the drive medium to the launch member.

7. The system of claim 1 additionally comprising a plurality of targets, at least one of which is mounted above another, such that a single launch member impact with the projectile may cause the projectile to travel through more than one of the targets.

8. The system of claim 1 wherein a plurality of deformable containers are independently in fluid communication with a plurality of launch members.

9. The system of claim 8 wherein two or more of the plurality of launch members are positioned adjacent to each other, and wherein the adjacent positioning of the two or more launch members defines a projectile impact location such that each launch member will impact the projectile if actuated when the projectile is at the projectile impact location.

10. The system of claim 9 wherein the two or more adjacent launch members are pistons.

11. The system of claim 10 wherein the longitudinal axes of the two or more adjacent pistons diverge.

12. The simulated basketball game of claim 1, wherein said material forms a hollow resilient shell at least partially surrounding said portion of said drive medium.

13. A system for launching a projectile toward a target comprising:

a projectile;

a deformable container having a drive medium contained therein, and comprising material within the interior thereof for returning the deformable container to its initial configuration following deformation, wherein the material comprises a resilient foam portion and a rigid foam portion such that the resilient foam portion returns the deformable container to its initial configuration following deformation and the rigid foam portion restricts the container's capacity for deformation.

a launch member in fluid communication with the deformable container and responsive to the drive medium such that deformation of the container is communicated to the launch member via the drive medium to cause the launch member to impact the projectile; and, a target positioned with respect to the launch member such that launch member impact with the projectile enables the projectile to travel toward the target.

14. The system according to claim 13 wherein the resilient foam portion is open cell polyurethane foam and the rigid foam portion is closed cell polyethylene foam.

15. The system of claim 13 wherein the drive medium is a liquid.

16. The system of claim 13 wherein the drive medium is a gas.

17. The system of claim 13 wherein the container is deformed in response to physical pressure applied by an operator.

18. The system of claim 13 wherein the launch member is a piston.

19. The system of claim 13 wherein fluid communication between the deformable container and the launch member is accomplished via a conduit extending between the container and the launch member so as to communicate the drive medium to the launch member.

20. The system of claim 13 additionally comprising a plurality of targets, at least one of which is mounted above another, such that a single launch member impact with the projectile enables the projectile to travel through more than one of the targets.

21. The system of claim 13 wherein a plurality of deformable containers are independently in fluid communication with a plurality of launch members.

22. The system of claim 21 wherein two or more of the plurality of launch members are positioned adjacent to each other, and wherein the adjacent positioning of the two or more launch members defines a projectile impact location such that each launch member will impact the projectile if actuated when the projectile is at the projectile impact location.

23. The system of claim 22 wherein the two or more adjacent launch members are pistons.

24. The system of claim 23 wherein the longitudinal axes of the two or more adjacent pistons diverge.

25. An apparatus comprising:

a projectile;

a compressible container partially bounded by flexible material and partially bounded by a rigid vented surface, said container enclosing material within the interior thereof for returning the deformable container to its initial configuration following deformation, said material having an outer surface substantially following the inner surface of said flexible material, and forming a hollow shell enclosing an interior compressible pocket:

a piston, situated such that piston travel may cause piston impact with the projectile;

a conduit for pressure communication between the container and the piston such that container compression causes piston travel, thereby causing piston impact with the projectile.

26. The apparatus of claim 25 wherein said material is open cell polyurethane foam.

27. The apparatus of claim 26 additionally comprising a plurality of targets, at least one of which is mounted above the others, such that a single piston impact with the projectile can cause the projectile to travel through more than one of the targets.

28. The apparatus of claim 27 wherein the plurality of targets comprises three targets arranged vertically on a common axis.

29. The apparatus of claim 28 wherein the targets are simulated basketball nets.

30. The apparatus of claim 29 additionally comprising a projectile impact location proximate the piston, and means for loading projectiles onto the projectile impact location when no projectile is present thereon.

31. The apparatus of claim 30 additionally comprising more than one projectile.

32. A system for propelling a projectile comprising:

a projectile;

a projectile impact location;

an operator impact surface;

multiple propelling means for propelling the projectile from the projectile impact location in response to operator contact with the operator impact surface; and, a common control means associated with the propelling means for causing the trajectory of the projectile to vary with variations in the location or direction of operator contact with the operator impact surface.

33. An apparatus for propelling a projectile comprising:

a projectile;

a projectile impact location;

an operator impact surface;

a plurality of air pockets associated with the operator impact surface such that a single operator contact with the operator impact surface can compress more than one of the air pockets;

a plurality of pistons situated proximate the projectile impact location such that each piston will impact the projectile if actuated when the projectile is at the projectile impact location; and, a plurality of conduits for providing separate pressure communication between each air pocket and each piston such that an air pocket compression actuates a corresponding piston, thereby causing piston impact with the projectile.

34. The apparatus of claim 23 wherein the longitudinal axes of the pistons diverge.

35. The apparatus of claim 34 wherein the air pockets are partially bounded by flexible material and partially bounded by a rigid vented surface.

36. The apparatus of claim 35 wherein the flexible boundary comprises a cylindrical bellows wherein one end of the bellows is fixed with respect to the remainder of the apparatus, and the other end of the bellows is movable with respect to the remainder of the apparatus.

37. The apparatus of claim 36 additionally comprising a plurality of targets, at least one of which is mounted above the others, such that a single piston impact with the projectile can cause the projectile to travel through more than one of the targets.

38. The apparatus of claim 37 wherein the targets are simulated basketball nets.

39. The apparatus of claim 38 wherein the plurality of targets comprises three targets arranged vertically on a common axis.

40. The apparatus of claim 39 additionally comprising means for loading projectiles onto the projectile impact location when no projectile is present thereon.

41. The apparatus of claim 40 additionally comprising more than one projectile.

42. An apparatus for propelling a projectile comprising:

a projectile;

a projectile impact location;

a plurality of pistons situated proximate the projectile impact location such that each piston will impact the projectile if actuated when the projectile is at the projectile impact location, and such that varying the force or timing of each piston impact with said projectile varies the trajectory of the projectile; and, a common operator impact surface in communication with each of said plurality of pistons such that varying the location or force of an operator contact with said operator impact surface varies the force or timing of each piston impact with the projectile.

43. The apparatus of claim 42 additionally comprising a plurality of air pockets associated with said operator impact surface, and wherein said pistons communicate with said air pockets via conduits for providing separate pressure communication between each air pocket and each piston such that compression of a particular air pocket actuates a corresponding piston, thereby causing piston impact with the projectile.

44. An apparatus for propelling a projectile comprising:

a projectile;

a projectile impact location;

a plurality of air pockets bounded by vented cylindrical bellows wherein one end of the bellows is fixed with respect to the remainder of the apparatus and the other end of the bellows is moveable with respect to the remainder of the apparatus;

a plurality of pistons situated proximate the projectile impact location such that each piston will impact the projectile if actuated when the projectile is at the projectile impact location; and, a plurality of conduits for providing separate pressure communication between each air pocket and each piston such that an air pocket compression actuates a corresponding piston, thereby causing piston impact with the projectile; and, means for loading projectiles onto the projectile impact location when no projectile is present thereon.

45. The apparatus of claim 44 additionally comprising a plurality of targets, at least one of which is mounted above the others, such that a single piston impact with the projectile can cause the projectile to travel through more than one of the targets.

46. The apparatus of claim 45 wherein the targets are simulated basketball nets.

47. The apparatus of claim 45 wherein the plurality of targets comprises three targets arranged vertically on a common axis.

48. The apparatus of claim 44 additionally comprising more than one projectile.

49. An apparatus comprising:

a projectile;

a compressible container partially bounded by flexible material and partially bounded by a rigid vented surface, said container enclosing material within the interior thereof for returning the deformable container to its initial configuration following deformation, wherein the material comprises a resilient foam portion and a rigid foam portion such that the resilient foam portion returns the deformable container to its initial configuration following deformation and the rigid foam portion restricts the container's capacity for deformation;

a piston, situated such that piston travel enables piston impact with the projectile;

a conduit for pressure communication between the container and the piston such that container compression causes piston travel, thereby causing piston impact with the projectile.

50. The apparatus of claim 49 wherein said resilient foam portion comprises open cell polyurethane foam.

51. The apparatus of claim 50 additionally comprising a plurality of targets, at least one of which is mounted above the others, such that a single piston impact with the projectile can cause the projectile to travel through more than one of the targets.

52. The apparatus of claim 51 wherein the plurality of targets comprises three targets arranged vertically on a common axis.

53. The apparatus of claim 52 wherein the targets are simulated basketball nets.

54. The apparatus of claim 53 additionally comprising a projectile impact location proximate the piston, and means for loading projectiles onto the projectile impact location when no projectile is present thereon.

55. The apparatus of claim 54 additionally comprising more than one projectile.

* * * * *

UNITED STATES PATENT AND TRADEMARK OFFICE

CERTIFICATE OF CORRECTION

PATENT NO. 5,681,043
DATED : October 28, 1997
INVENTOR(S) : Winblad et al.

It is certified that error appears in the above-identified patent and that said Letters Patent is hereby corrected as shown below:

Column 10,
Line 54, which reads "claim i", should read -- claim 1 --.

Signed and Sealed this

Twenty-first Day of May, 2002

*Attest:*

*Attesting Officer*

JAMES E. ROGAN
*Director of the United States Patent and Trademark Office*